US005763148A

United States Patent [19]

Willems et al.

[11] Patent Number: 5,763,148

[45] Date of Patent: Jun. 9, 1998

[54] MATERIAL FOR INDUSTRIAL RADIOGRAPHY AND DEVELOPMENT METHOD THEREOF

[75] Inventors: Peter Willems, Stekene; Freddy Henderickx, Olen; Marcel Monbaliu, Mortsel, all of Belgium

[73] Assignee: AGFA-Gevaert, N.V., Mortsel, Belgium

[21] Appl. No.: 682,354

[22] Filed: Jul. 17, 1996

Related U.S. Application Data

[60] Provisional application No. 60/003,585 Sep. 12, 1995.

[30] Foreign Application Priority Data

Jul. 31, 1995 [EP] European Pat. Off. ..... 95202080

[51] Int. Cl.[6] ..... G03C 1/42; G03C 1/76; G03C 5/29

[52] U.S. Cl. ..... 430/405; 430/566; 430/444; 430/438; 430/440; 430/448

[58] Field of Search ..... 430/566, 444, 430/405, 438, 440, 448

[56] References Cited

U.S. PATENT DOCUMENTS

| | | | |
|---|---|---|---|
| 4,214,047 | 7/1980 | Chen | 430/536 |
| 4,346,154 | 8/1982 | McLaen et al. | 430/566 |
| 4,810,623 | 3/1989 | Kokelenberg et al. | 430/448 |

*Primary Examiner*—Mark F. Huff
*Attorney, Agent, or Firm*—Breiner & Breiner

[57] ABSTRACT

A silver halide photographic activation material is disclosed comprising a film support, on one or both sides thereof at least one gelatino silver halide emulsion layer and between said emulsion layer and said support a hydrophilic undercoat layer comprising as a binder at least 50% of a loaded latex polymer, said latex polymer being loaded with at least one developing agent, further characterised in that water absorption during activation processing is not higher than 2.5 g per gram of binder present in said material.

13 Claims, No Drawings

MATERIAL FOR INDUSTRIAL RADIOGRAPHY AND DEVELOPMENT METHOD THEREOF

DESCRIPTION

1. Field of the Invention.

The present invention relates to silver halide photographic materials for activation processing and to a method of activation processing said materials.

2. Background of the Invention.

In normal processing of exposed silver halide photographic materials the various processing steps developing, fixing, followed by rinsing and drying, are carried out at ambient temperature (20°–25° C.) and require a relatively long total time of several minutes. Therefore, there is a general trend to enhance the speed of processing. Moreover, higher temperatures, accelerate not only the developing but also aerial oxidation of the developing agents therein so that developing baths without special protection measures against the oxygen of the air, become rapidly exhausted and cause stain. Further, higher temperatures than the ambient require a certain input of energy which makes high temperature processing less economical. In addition to the temperature the alkalinity of the developer plays a major role in rapid access processing and is normally situated in a pH range of from 10 to 12. The higher the alkalinity the faster the development proceeds but also the more rapidly the developer is oxidised by the air.

In order to avoid the disadvantages of normal development with developing agent(s) in alkaline developing solutions so-called activation processing has been introduced.

Activation processing is applied e.g. in combination with rapid access stabilisation as has been described in U.S. Pat. No. 4,030,924 and in U.S. Pat. No. 4,810,623. In activation processing use is made of silver halide photographic materials containing already before image-wise exposure one or more developing agents in their composition e.g. in a hydrophilic colloid layer adjacent to a gelatino silver halide emulsion layer. The processing bath used in an activation development of the latent silver image is an aqueous alkaline solution being free from any developing agent.

As ecology is becoming more and more important the choice for customer- and environmental-friendly compositions of the so-called "activation materials" and of "activation processing liquid" becomes more and more stringent.

Activation processing methods are thus favourable in that no developing agents sensitive to oxidation are required in the developer, but that the said agents are incorporated in the silver halide photographic material that should be processed, called therefor "activation material" and that the "developing liquid" substantially consists of an aqueous alkaline solution having a high pH value of at least 13, in order to activate the incorporated developing agents in the developing step.

Besides rapid processing the user-friendly character of activation processing is highly appreciated as e.g. replenishment of the activating solution is restricted to addition of water in order to compensate for vaporisation of the said solution.

Hitherto activation processing has been restricted to silver halide photographic materials comprising silver halide grains rich in chloride as e.g. in graphic materials for camera applications, known e.g. as "Rapidoprint" trade name products from Agfa-Gevaert. Silver halide emulsion grains coated in emulsion layers of said materials are preferably rich in chloride as they are processed much more rapidly than grains having another halide composition: only concentrations of silver bromide therein of up to 2 mole % of bromide are optionally allowed. Before completion of the developing step oxidised and residual developing agent(s) should already have left the film, in favour of physical properties of the processed material.

Activation materials generally comprise a topcoat protective antistress layer, provided onto at least one light-sensitive gelatinous silver halide emulsion layer having emulsion grains rich in chloride for reasons set forth hereinbefore, wherein between the emulsion layer closer to the support and the support a gelatinous undercoat layer is provided, loaded with at least one developing agent.

As a consequence a relatively high coated amount of gelatin is required in order to keep the developing agents therein in a preferable dipersed form. Higher amounts of gelatin are disadvantageous in that higher amounts of water are absorbed in the processing and that the drying process of the thicker coating layers takes more time.

In particular the need for dimensionally stable graphic materials gives rise to problems e.g. where colour selections of one picture should be brought into register on the said materials. Moreover the presence of incorporated developing agents in high amounts of gelatin makes the material become sticky, especially in conditions of high relative humidity.

Further the presence in "activation materials" of developing compounds having reducing properties makes the preservation stability decrease.

OBJECTS OF THE INVENTION

Therefore it is a first object of this invention to provide a silver halide photographic activation film material coated from lower amounts of gelatin in a hydrophilic layer having incorporated developing agents in order to reduce water absorption in the activation processing, in order to reduce sticking at high relative humidity levels and in order to enhance dimensional stability, without reducing rapid access performance offering the required sensitometric characteristics.

A second object of this invention is to provide a material having good preservability characteristics, being acceptably customer-friendly and environmental-friendly, having a layer composition that is fully in accordance with those two demands.

A third object of this invention is to provide a material maintaining an excellent image quality, especially image sharpness, and good physical properties.

Other objects will become apparent from the description hereinafter.

SUMMARY OF THE INVENTION.

The above objects are accomplished by providing a silver halide photographic activation material comprising a film support, on one or both sides thereof at least one gelatino silver halide emulsion layer and between said emulsion layer and said support a hydrophilic undercoat layer comprising as a binder at least 50% of a loaded polymer latex, said polymer latex being loaded with at least one developing agent, further characterised in that water absorption during activation processing is not higher than 2.5 g per gram binder present in said material.

Further a method of processing said activation material is disclosed, comprising the step of contacting the exposed photographic material with an aqueous alkaline liquid, called activator liquid, being initially substantially free from developing agent(s), having a pH value of at least 10.

DETAILED DESCRIPTION OF THE INVENTION.

To solve the problems set forth hereinbefore and to offer a broader range of applications to activation materials a range of experiments has been set up in order to obtain activation materials having non-diffusing incorporated developing agents before activation processing. If incorporated developing agents are made nondiffusible there is less interaction between gelatin and said developing agent(s) or between silver halide emulsion crystals in the emulsion layer(s) and said developing agent(s) than if said developing agents are diffusible.

It is clear that the right choice of a suitable binder for the undercoat layer has been one of the most important objects. The following conditions have been formulated as being important in order to reach the objects of this invention. The binder should have a hydrophilic composition, should be compatible with the incorporated developing agent(s), should be overcoatable with a gelatinous silver halide emulsion layer, should have a good adhesion to the subbing layer coated onto the support, should result in a good scratch resistance of the activating material and should have a strongly reduced water absorption. Ballasted and masked developers were tested as described in RD 17364 (1987), in EP-A 0 532 192 and in CA 766,708 but an acceptable result was not found.

It has now unexpectedly been found from a range of experiments that use as a binder of a loaded polymer latex in the hydrophilic undercoat layer, preferably of a polyurethane latex, loaded with at least one developing agent, brings a solution for the problems set forth hereinbefore, the proviso that said polymer latex loaded with said developing agent(s) is present in an amount of at least 50% by weight of the total amount of binder and the proviso that amounts of water absorption, measured after immersion of the activation material in demineralised water of 25° C. for 3 minutes, are not more than 2.5 g, and more preferably not more than 2.0 g of water per gram of binder.

Said polymer latex preferably is a polyurethane latex. As a practically useful polyurethane latex, the latex sold under the name IMPRANIL 43056, sold by BAYER AG, Leverkusen, Federal Republic of Germany was chosen. This IMPRANIL-latex is a 40% aqueous dispersion of polyurethane prepared from DESMODUR W (trademarked product from BAYER AG), which is a dicyclohexylmethane diisocyanate, and a polyester having a low molecular weight of about 800. The average particle size of the loaded latex may vary between 0.02 and 0.2 μm.

The loaded latex can be prepared by addition of the aqueous loadable polyurethane latex to a solution of developing agent(s) in a water-miscible organic solvent as e.g. acetone, or by simultaneous addition of said latex and said solution to an aqueous gelatinous solution as gelatin is a preferred binder for said loaded latex. In accordance with this invention however the amount of loaded latex should be more than 50% by weight, resulting in an amount of another binder, preferably gelatin, in the undercoat layer between support and emulsion layer of less than 50% by weight. In addition a whitening agent as 1-ethyl-3-phenyl-7-dimethylamino-2-quinolone, which can also be loaded onto the polymer IMPRANIL latex, may be added especially when the layers of the activation material are coated on a paper support.

The developing agent(s) are thus incorporated in a hydrophilic colloid activation layer in waterpermeable relationship with the emulsion layer situated more closely to the support. In a particular embodiment said activation layer is an antihalation layer, containing antihalation dyes as described in EP-Application 95201822, filed Jul. 4, 1995. Most preferably the dyes used in the antihalation undercoat layer are non diffusible at the pH of the coating solution, to prevent the dyes from migrating to the light-sensitive layer before the activation development. In the development composition the dyes should become diffusable in order to get a low residual rest colour. It is even more preferred to have both an antihalation undercoat and an antihalation overcoat layer. Said antihalation overcoat layer, coated on top of the light-sensitive layer is used e.g. in order to make the emulsion layer insensitive to darkroom light.

In a preferred embodiment a mixture is used of developing agents including a dihydroxybenzene and a 3-pyrazolidine-1-one developing agent, well-known as an electron transfer agent or super additive developer. These developing agents are used preferably in a respective molar ratio of from 2/1 to 10/1. The dihydroxybenzene or dihydroxybenzenes is(are) preferably present in an amount of from 0.05 to 0.5 g for a coverage of silver halide equivalent with 1 g of silver nitrate. Ascorbic acid, iso-ascorbic acid whether or not in combination with the preferred developing agent(s) can also be used.

A preferred dihydroxybenzene for use in a photographic activation material according to the invention is the p-hydroxybenzene compound hydroquinone.

3-Pyrazolidine-1-one developing compounds which are useful as auxiliary developing agents in a photographic material developed according to the present invention are within the scope of the following general formula:

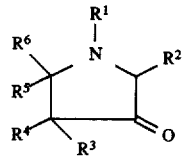

wherein:

$R^1$ represents an aryl group including a substituted aryl group e.g. phenyl, m-toluyl and p-toluyl, $R^2$ represents hydrogen, a lower ($C_1$–$C_3$) alkyl group, e.g. methyl, or an acyl group, e.g. acetyl, each of $R^3$, $R^4$, $R^5$ and $R^6$ (which may be the same or different) represents hydrogen, an alkyl group, preferably a $C_1$–$C_5$ alkyl group including a substituted alkyl group, or an aryl group including a substituted aryl group. 1-Aryl-3-pyrazolidinone compounds within the scope of the above formula and suitable for use according to the present invention are known e.g. from GB-A 1,093,177 filed Dec. 16, 1964, by Gevaert Photoproducten N.V.

Examples thereof are:

1-phenyl-3-pyrazolidine-1-one also known as "phenidone"
1-(m-tolyl)-3-pyrazolidinone
1-phenyl-4-methyl-3-pyrazolidinone
1-phenyl-5-methyl-3-pyrazolidinone
1-phenyl-4,4-dimethyl-3-pyrazolidinone
1,5-diphenyl-3-pyrazolidinone
1-(m-tolyl)-5-phenyl-3-pyrazolidinone
1-(p-tolyl)-5-phenyl-3-pyrazolidinone
and mixtures thereof.

The silver halide emulsion layer(s) of a photographic material developed according to the present invention preferably contain(s) gelatin as a hydrophilic binding agent. However, the gelatin may be partly replaced by other natural and/or synthetic hydrophilic colloids, e.g., albumin, casein or zein, polyvinyl alcohol, alginic acids, cellulose derivatives such as carboxymethylcellulose and modified gelatin. Also colloidal silica sol may be used.

The ratio by weight of hydrophilic colloid binder to silver halide, expressed as an equivalent amount of silver nitrate, in the silver halide emulsion layer(s) of the photographic material developed according to the method of the present invention is preferably in the range of from 0.3 up to 1.0, more preferably up to 0.8, and still more preferably up to 0.6 in order to provide a shorter drying time.

In addition to the binder, silver halide and developing agent(s) the silver halide photographic material may contain in the light-sensitive emulsion layer(s) and/or in one or more layers in water-permeable relationship with said silver halide emulsion layer(s) any of the kinds of compounds customarily used in such layers for improving the photographic process, manufacture or preservability (storage). For example such layers may incorporate one or more coating aids, stabilising agents or antifogging agents as described e.g. in GB-A 1,007,020 filed Mar. 6, 1963 by Agfa A.G., plasticisers, development-modifying agents, e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the EP-Specification 0 026 520.

The silver halide emulsion crystals used in the silver halide emulsion layer(s) are, in accordance with this invention, not restricted to be composed of pure silver chloride crystals. Even crystals composed of silver chlorobromide, silver chlorobromoiodide composition are activation processable if coated in the emulsion layer(s) of the activation material according to this invention. Amounts of bromide of not more than 30 mole % and of iodide of not more than 2 mole % are preferred. More preferred amounts of bromide are from 10 to 20 mole %, whereas an iodide content of from 0.2 to 1 mole % is more preferred. Said silver halide crystals preferably have a grain size of at least 0.15 μm, up to at most 1.2 μm, more preferably up to 1.0 μm and still more preferably up to 0.8 μm.

For the preparation of gelatino silver halide emulsion having the compositions described hereinbefore conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains the gelatin concentration is kept from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. The gelatin to silver halide ratio then ranges from 0.3 to 0.6. Although the precipitation in connection with the present invention can be principally performed by one double jet step, it is preferred to perform a sequence of a nucleation step and at least one growth step. Of the total silver halide precipitated preferably 0.5% to 5.0% is added during said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater then at the start of the growth step. These flow rates can be monitored by e.g. magnetic valves. There can be a homogeneous distribution of the silver halide used over the whole volume of the silver halide crystals, for which the composition of the halide solution remains unchanged during the whole precipitation. However, a core-shell or multistructure emulsion can be used wherefore the composition of the halide solutions is varied during the growth stage. The moment at which this change has to take place depends on the desired thickness of the core and the shell and on the amounts and the ratio of chloride to bromide to iodide ions that are built into the crystals. Within the scope of this invention an amount of not more than 30 mole % of bromide ions and of not more than 2 mole % of iodide may be built into the silver halide crystals, whether it is built in homogeneously or, as is the case for core-shell emulsions, heterogeneously. In order to get a homogeneous silver halide crystal distribution after precipitation it is recommended that before the start and during the different stages of the precipitation the pAg is controlled versus a calomel electrode, used as a reference electrode, during the nucleation step as well as during the growth step depending on the halide compositions used and pH is maintained between 5.2 and 5.8 preferably between 5.5 and 5.8. When using conventional precipitation conditions silver halide emulsion grains show a cubic morphology with (100) crystal faces offering better developing characteristics than other crystallographic forms, as, e.g. octahedral, rhombic, dodecahedral or tabular silver halide crystals. However silver halide emulsions having crystallographic forms other than cubic can be used, as e.g. tabular silver halide grains used in an activating material as described in EP-A 0 616 254, which is incorporated herein by reference.

After completion of the precipitation a wash technique in order to remove the excess of soluble salts is applied at a pH value which can vary during washing but remains comprised between 3.7 and 3.3 making use of a flocculating agent like polystyrene sulphonic acid. Normally the emulsion is washed by diafiltration by means of a semipermeable membrane, also called ultrafiltration, so that it is not necessary to use polymeric flocculating agents that may disturb the coating composition stability before, during or after the coating procedure. Such procedures are disclosed, e.g. in Research Disclosure Vol. 102, October 1972, Item 10208, Research Disclosure Vol. 131, March, Item 13122 and Mignot U.S. Pat. No. 4,334,012. Preferably at the start of the ultrafiltration there is no pH and pAg adjustment; pH and pAg are the same as at the end of the preceding precipitation without any adjustment stage.

The gelatino silver halide emulsions coated in the silver halide emulsion layers of the activation materials of the present invention may be chemically sensitised as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Friese and published by Akademische Verlagsgesellschaft (1968). As described in the cited literature chemical sensitisation may be carried out by effecting the ripening in the presence of small amounts of compounds containing sulphur, selenium or tellurium, e.g. thiosulphate, thiocyanate, and the corresponding selenium and tellurium compounds, thioureas, sulphites, mercapto compounds, and rhodamines. The emulsions can be sensitised also by means of gold-sulphur, gold-selenium, gold-tellurium ripeners or combinations thereof or by means of reductors, e.g. tin compounds as described in GB-A 789,823, amines, hydrazine derivatives, formamidine-sulphinic acids, etc.

The silver halide emulsion crystals can be spectrally sensitised wherein the choice of a suitable sensitiser depends on the application, i.a. the exposure conditions of the activation material according to this invention. An overview of useful spectral sensitisers has been given, e.g., in Research Disclosure 36544, September 1994, chapter V.

The silver halide emulsion layer(s) of the materials in accordance with the present invention or the non-light-sensitive layers may comprise compounds preventing the formation of fog or stabilising the photographic characteristics during the production or storage of the photographic elements or during the photographic treatment thereof. Many known compounds can be added as fog-inhibiting agent or stabiliser to the silver halide emulsion at any stage of the emulsion preparation. Suitable examples are, e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB-A's 1,203,757; 1,209,146 and 1,500,278 and in JP-A 75-39537, and 7-hydroxy-s-tria-zolo-[1,5-a]-pyrimidines as described in U.S. Pat. No. 4,727,017, and other compounds such as benzenethiosulphonic acid, benzenethiosulphinic acid and benzenethiosulphonic acid amide.

In a specific embodiment, e.g. for camera photographic materials, the presence of one or more hydrazine compounds in view of their contrast increasing and development accelerating properties is recommended. This can be a formylphenyl-hydrazide, but also more complicated hydrazide derivatives are possible, e.g. sulfonamidohydrazides. These hydrazides are advantageously combined with so-called incorporated boosters, e.g. a long-chain tertiair amine booster.

To improve the developing speed, activators such as polyglycols, thioether substituted polyglycols, and polymers carrying an endstanding onium group, e.g. a pyridinium group can also be used.

The gelatin binder of the photographic elements according to the present invention can be hardened with appropriate hardening agents such as those of the epoxide type, those of the ethylenimine type, those of the vinylsulfone type, e.g. 1,3-vinylsulphonyl-2-propanol, aldehydes as e.g. formaldehyde, glyoxal, and glutaric aldehyde, N-methylol compounds as e.g. dimethylolurea and methyloldimethylhydantoin, dioxan derivatives as e.g. 2,3-dihydroxy-dioxan, active vinyl compounds as e.g. 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Hardening is to such an extent that when the photographic material is immersed in demineralised water of 25° C. at most 2.5 g of water is absorbed per gram of gelatin in 3 minutes and even more preferred at most 2.0 g. In order to get such a low absorption amount of water the amount of gelatin in the emulsion layer should be decreased as there may otherwise be a problem with sticking. Indeed due to the incorporation of developing agents the hardening degree of the layers decreases. To avoid this extra gelatin should be added to the coating layers. An acceptable compromise can be attained by leaving the amount of gelatin in the activation layer unchanged and by lowering the said amount in the emulsion layer or layers.

The support for the light-sensitive silver halide emulsion layer(s) may be any opaque or transparent support customarily employed in the art. Transparent supports are usually made of organic resins, e.g. polyethylene terephthalate or polyethylene naphthalate, whereas opaque supports are usually made of paper either or not coated with a water-impermeable layer of e.g. a polyolefine such as polyethylene. The support of the photographic material in accordance with the present invention may be a transparent resin, preferably a blue coloured polyester support like polyethylene terephtalate. The thickness of such organic resin film is preferably about 100 μm. The support is provided with a substrate layer at both sides to have good adhesion properties between the most adjacent emulsion layer and said support.

The photographic material according to the present invention is preferably a single side coated material having a backing layer at the other side of the support or a duplitized material having on one or both sides of the film support more than one emulsion layer. Said emulsion layers are overcoated with a protective antistress layer. Said protective antistress layer may contain one or more developing agent, whether or not differing from the developing agents described hereinbefore. To improve the visual difference between backing layer and emulsion layer under darkroom illumination, it is useful to add in a backing layer or in an emulsion layer a dye that has an absorption maximum in the wavelength range of the darkroom illumination (so-called recognition dye). To improve the darkroom stability (build up of fog, dot growth) of the material under darkroom illumination, it is useful to add in a hydrophilic layer a dye that has an absorption maximum in the wavelength range of the darkroom illumination. It is most preferred to add a dye that does not dissolve in water at pH less then 6.0, in a layer on top of the light-sensitive imaging layer to improve the darkroom stability.

The photographic activation material according to this invention can be image-wise exposed by means of several exposure units that can also be employed for other light-sensitive materials. So a light source can be used that matches the wavelength-dependent sensitivity of the light-sensitive material.

Ecologic advantages of the system according to this invention are related with the low amount of processing liquids that are consumed: the activator bath should only be replenished as a consequence of evaporation and "cross-over". Amounts of about 50 to 75 ml per square meter are sufficient as there is a low crossover thanks to the low amount of water absorption of the activation material. Fixer regeneration amounts can be further reduced by means of electrolysis. A further advance of low crossover amounts of activator means that also lower amounts of washing water are required.

By "initially substantially free of developing agent(s)" is meant that an amount not more than 0.014 mole of developing agent(s) is present in the alkaline aqueous activation liquid at the start of the development.

The development preferably proceeds at a pH in the range from 10 to 14, and more preferably in the range from 12 to 14. In said pH range developing agents, e.g. hydroquinone(s), present in an amount higher than defined above yield strongly coloured developing baths by oxidation with oxygen of the air. The activation development may be carried out at various times and temperatures e.g. at a temperature in the range from 10° to 40° C., more preferably in the range from 20° to 30° C. and still more preferably at room temperature. Development times of less than 10 seconds can be achieved in this way.

The contacting of the photographic material with an alkaline solution may proceed by any contacting technique known in the art, e.g. by dipping, meniscus coating, spraying or pod processing. It may proceed manually or automatically in a developing apparatus known to those skilled in the art.

According to a special embodiment the alkalinity of the developer solution is partly obtained by an alkali-releasing agent consisting of a sodium or potassium salt, e.g. sodium citrate, which reacts with a very slightly water-soluble metal hydroxide, e.g. zinc hydroxide, as described, e.g. in U.S. Pat. No. 3,260,598. Apart from the necessary alkali, e.g. sodium hydroxide, to obtain a pH in the range of 12 to 14, some amount of anti-oxidising agent, e.g. a sulphite to protect the developing agents against aerial oxidation is added.

In a preferred embodiment said aqueous alkaline liquid comprises at least one of the compounds selected from the group consisting of sodium hydroxide, potassium hydroxide, sodium carbonate, potassium carbonate, sodium phosphate, potassium phosphate and ammonium hydroxide.

Fixers having high sodium thiosulphate concentrations are preferred over ammonium thiosulphate containing fixers for ecological reasons. They are useful in those circumstances wherein no replenishment system is available or where it is desirable to minimise the replenishment amounts. Such fixers retain a high silver binding capacity and a sufficient fixing speed even after prolonged continuous processing without replenishment or with minimum replenishment. An example thereof has been given in Research Disclosure 355 039, p. 736–737, published Nov. 1, 1993, which is incorporated herein by reference.

The present invention is illustrated by the following examples without however being limited thereto.

EXAMPLES

Examples 1

General preparation of the photographic material.

A photographic material was prepared composed of a subbed polyester base (100 μm thick);

an undercoat layer comprising developing agent(s) as described hereinafter (see: "variation of the composition of the undercoat layer" for films A to D);

an emulsion layer comprising a gelatin-silver halide emulsion (preparation described hereinafter) of which the silver halide consists for 83.6% of silver chloride, 16% of silver bromide and 0.4% of silver iodide having a cubic habit, an average grain size of 0.30 μm and a gelatin to silver chlorobromoiodide ratio (expressed as an equivalent amount of silver nitrate) of 0.45, being coated at a coverage corresponding with 7.25 g of silver nitrate per $m^2$;

a gelatin covering layer (protective anti-stress layer) containing 0.126 g of hydroquinone and 0.050 g of 1-p-carboxyphenyl-3,3'-dimethyl-pyrazolidine-1-one and 0.92 g of gelatin per $m^2$.

The gelatin containing layers were hardened with formaldehyde to improve their mechanical strenght.

Loaded polymer latex IMPRANIL 43056 (description given hereinbefore), was prepared as follows:

A 40% by weight of IMPRANIL-latex was diluted with water in order to obtain a 20% latex. pH was adjusted with acetic acid.

Developing agents were dissolved in aceton at room temperature (an amount of aceton was used having not more than the weight of the said latex).

The 20% by weight solution of said latex was added to the aceton solution at a rate of 5 minutes per litre, followed by stirring during 15 minutes.

Aceton was evaporated at 35° C. until 90% of the amount of loaded latex was reached. pH was adjusted, if required, and the right end volume was adjusted with demineralised water.

After about 12 hours an equilibrium was obtained and filtration was started.

An alternative preparation method consists in

Diluting a 40% by weight of IMPRANIL-latex with water in order to obtain a 20% latex. pH was adjusted with acetic acid.

Heating said latex up to 80° C.

Adding developing agents and stirring further during 20 minutes.

Cooling under stirring conditions are held constant until room temperature has been reached.

Controlling pH and adepting it eventually.

Filtration starting after about 12 hours (when an equilibrium was obtained).

Preparation of the silver chlorobromoiodide emulsion.

The silver chlorobromoiodide emulsion having 83.6 mole % of chloride, 16 mole % of bromide and 0.4 mole % of iodide was prepared by the double jet technique.

5 minutes before starting the precipitation $Na_2IrCl_6.6H_2O$ was added to the halide solution in an amount to get a concentration in the grains of 0.63 μmole per mole of silver halide. Stirring was performed at 350 rpm. The reaction vessel and the silver and halide solutions were kept at a constant temperature of 50° C.

In the precipitation vessel containing 2.8 l of demineralised water and 110 g of inert gelatin, solutions of 1.96 molar of silver nitrate and 1.71 molar of halide (ratio of chloride to bromide to iodide being 77.53: 22.22: 0.25; bromide and iodide present as potassium salt, chloride as sodium salt) were run by means of the double jet technique during 15 minutes at a velocity of 133.33 ml per minute and 83.6 ml per minute respectively.

After a physical ripening time of 5 minutes solutions of 0.98 molar of silver nitrate and 1.64 molar of sodium chloride were run by means of the double jet technique during 9 minutes at a velocity of 116.67 ml per minute and 82.22 ml per minute respectively.

After the end of the precipitation a physical ripening time of 15 minutes was applied under the same stirring conditions and the flocculation procedure could begin: pH was adjusted at a value of 3.3 with sulphuric acid 3M, and 13 g of polystyrene sulphonic acid was added slowly in 2 minutes. The washing procedure was performed in a discontinous way, adding 6 l of demineralised water, followed by washing and decanting. This procedure was repeated three times.

After addition of inert gelatin to a ratio of gelatin to silver nitrate in the emulsion of about 0.35, the emulsion was peptised and was chemically ripened to an optimal fog-sensitivity relationship at 52° C., pAg having a value of about 120 mV vs. a saturated calomel electrode used as a reference electrode. Chemical ripening agents were gold (in an amount of 0.027 mmole), sulphur (in an amount of 0.089 mmole) and toluene thiosulphonic acid (predigestion agent in an amount of 4 mg). Stabilisers as the sodium salt of 7-sulpho-naphto-[2,3-D]-oxazoline-2-thion and 1-phenyl-5-mercaptotetrazole were added in amounts of 40, respectively 30 mg per 100 g $AgNO_3$. Phenol was added as a biocide.

Variation of the composition of the undercoat layer (amounts expressed in g per g of silver nitrate)

Film A (comparative 1): 0.11 g of hydroquinone and 0.03 g of dimethylphenidone were added to a gelatinous coating solution of the undercoat layer in the conventional way.

Film B (comparative 2): 0.17 g of spiroindane (see compound A hereinafter) as a diffusion inhibited developing agent, 0.06 g of compound B and 0.03 g of 3-methyl-pyrazolidine-1-one (also called methylphenidone—compound C) were added in dispersed form in a conventional way to the same gelatinous coating solution.

Film C (inventive 1): 0.11 g of hydroquinone and 0.03 g of dimethylphenidone were loaded on IMPRANIL by the method described hereinbefore and added as such to the gelatinous coating solution of the undercoat layer. Ratios by weight obtained for the total amounts of latex and gelatin were 2:1.

Film D (inventive 2): 0.17 g of spiroindane and 0.03 g of methylphenidone were loaded on IMPRANIL by the method described hereinbefore and added as such to the gelatinous coating solution of the undercoat layer. Ratios by weight obtained for the total amounts of latex and gelatin were 2:1.

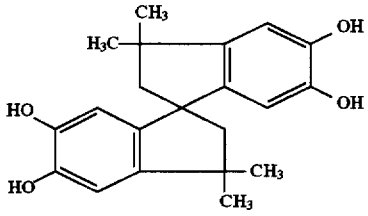

(compound A)

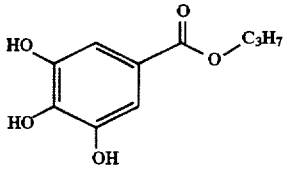

(compound B)

-continued

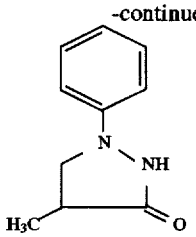

(compound C)

The thus obtained silver halide photographic material was exposed through a stepwedge with a xenon flash provided with a blue filter (in order to simulate an Argon-laser exposure with a monochromatic radiation having a wavelength of 488 nm) during $1\times10^{-5}$ seconds and was processed, in successive order, with an aqueous activation liquid, fixing liquid and rinsing liquid as defined hereinafter. The treatment in each liquid had a duration of 10 seconds at a temperature of 22° C.

Composition of the activation liquid (per litre).

| | |
|---|---|
| potassium hydroxide | 30 g |
| potassium sulphite | 50 g |
| potassium bromide | 2 g |
| ethylene diamine tetra acetic acid, sodium salt[2] | 1.5 g |

Composition of the fixing liquid (per litre).

| | |
|---|---|
| ammonium thiosulphate | 100 g |
| sodium sulphite | 17 g |
| sodium acetate | 15 g |
| citric acid | 2.5 g |
| acetic acid | 13 ml |

The rinsing liquid was distilled water.

Table 1 illustrates the degree of development obtained by measurement of the amount of exposed silver obtained in the maximum density after application of the activation development, fixing and rinsing cycle described hereinbefore and after calculation of the ratio of said amount of exposed silver and the amount of silver coated. Procentual amounts by weight of gelatin and polyurethane latex IMPRANIL are given for the undercoat layers of the film materials A to D, as well as amounts of water absorption per gram of gelatin obtained by application of the method of measuring said water absorption described hereinbefore.

TABLE 1

| Film | % of Ag developed | gelatin | latex | water abs. g/g binder |
|---|---|---|---|---|
| A (comp.1) | 60% | 100% | 0% | 3.00 |
| B (comp.2) | 50% | 100% | 0% | 3.60 |
| C (inv.1) | 98% | 38% | 62% | 2.03 |
| D (inv.2) | 90% | 29% | 71% | 1.92 |

As can be seen from Table 1 a convincing increase of the amount of developed silver is observed if the developing agents are loaded on polymer latex compounds as IMPRANIL polyurethane latex.

Moreover it is clear that the presence of said latex leads to a remarkable decrease of water absorption. As a consequence improving drying characteristics of the material according to this invention are observed.

EXAMPLE 2

The same materials as in Example 1 were prepared, except for the absence of gelatin in the undercoat layer:

gelatin (in the comparative coating) was replaced integrally by loaded polyurethane latex IMPRANIL in the inventive coating. A similar sensitometry was obtained for both materials although large differences in water absorption were measured: 2.75 g per g of binder in the presence of gelatin; 0.94 g per g of binder in the presence of said polyurethane latex.

We claim:

1. A silver halide photographic material comprising a film support, on one or both sides thereof at least one gelatino silver halide emulsion layer and between said emulsion layer and said support a hydrophilic undercoat layer comprising as a binder at least 50% by weight of a loaded polymer latex, said polymer latex being a polyurethane latex which is loaded with at least one developing agent, further characterized in that water absorption during activation processing is not higher than 2.5 g per gram of binder present in said material.

2. A silver halide photographic material according to claim 1, wherein water absorption during activation processing is not higher than 2.0 g per gram of binder present in said material.

3. A silver halide photographic material according to claim 1, wherein said developing agent is at least one dihydroxybenzene compound.

4. A silver halide photographic material according to claim 1, wherein said developing agents are dihydroxybenzene and 3-pyrazolidine-1-one compounds.

5. A silver halide photographic material according to claim 4 wherein said developing agents are used in a molar ratio of dihydroxybenzene to 3-pyrazolidine-1-one of from 2/1 to 10/1.

6. A silver halide photographic material according to claim 3, wherein said dihydroxybenzene compound(s) is(are) present in an amount of from 0.05 to 0.5 g for a coverage of silver halide equivalent with 1 g of silver nitrate.

7. A silver halide photographic material according to claim 3, wherein said dihydroxybenzene compound is hydroquinone.

8. A silver halide photographic material according to claim 1, wherein said gelatino silver halide emulsion layer comprises as silver halide emulsion crystals silver chloride, silver chlorobromide or silver chlorobromoiodide.

9. A silver halide photographic material according to claim 8, wherein silver halide crystals comprising silver bromide have up to 30 mole % of silver bromide and crystals comprising silver iodide have up to 2 mole % of iodide.

10. A silver halide photographic material according to claim 8, wherein said silver halide crystals have a cubic crystal habit.

11. Method for developing a radiographically exposed photographic material according to claim 1, comprising the step of contacting the said exposed photographic material with an aqueous alkaline liquid, called activator liquid, being initially substantially free from developing agent(s), having a pH value of at least 10.

12. Method according to claim 11, wherein said aqueous alkaline liquid has a pH in the range from 12 to 14.

13. Method according to claim 11, wherein said aqueous alkaline liquid comprises at least one of the compounds selected from the group consisting of sodium hydroxide, potassium hydroxide, sodium carbonate, potassium carbonate, sodium phosphate, potassium phosphate and ammonium hydroxide.

* * * * *